United States Patent [19]

Chen

[11] Patent Number: 4,984,793

[45] Date of Patent: Jan. 15, 1991

[54] RACKET HANDLE CAP

[76] Inventor: Dennis C. Chen, 9-1, Lane 161, Hsing An Road Sec. 1, Taichung, Taiwan

[21] Appl. No.: 402,889

[22] Filed: Sep. 5, 1989

[51] Int. Cl.[5] ..... A63B 49/08

[52] U.S. Cl. ..... 273/75; 273/81 A; 273/67 DB

[58] Field of Search ..... 273/735, 75, 81 R, 81 A, 273/81 D, 81.2, 67 DA, 67 DB

[56] References Cited

U.S. PATENT DOCUMENTS

| | | | |
|---|---|---|---|
| 399,340 | 3/1889 | Morgan | 273/75 |
| 2,086,062 | 7/1937 | Bray | 273/73 J |
| 3,501,148 | 3/1970 | Cheris | 273/75 |
| 3,848,480 | 11/1974 | Oseroff et al. | 273/75 |
| 3,995,856 | 12/1976 | Hollendorfer | 273/75 |
| 4,058,312 | 11/1977 | Stuff | 273/81 A X |
| 4,203,596 | 5/1980 | Nagamoto | 273/73 J |
| 4,600,195 | 7/1986 | Hunter | 273/81 A |
| 4,690,407 | 9/1987 | Reisner | 273/81 A |
| 4,819,939 | 4/1989 | Kobayashi | 273/75 X |

*Primary Examiner*—Edward M. Coven
*Assistant Examiner*—William E. Stoll

[57] ABSTRACT

A racket handle cap is of a pliant material in single piece injection molded construction and comprises an opening at one end therefrom elongately extending along a grip portion to a flaring section to define an internal cavity, an adhesive tape and a plurality of counter weights. The grip portion has a plurality of oval are circulation vents and circular air circulation vents which are respectively formed in rows for eliminating the air therethrough by inserting the handle part of a racket frame thereto. The counter weights respectively conform in shape with the oval circular air circulation vents for defining their optional and removable insertion to the oval and circular air circulation vents, whereby the weight adjustment and distribution of said racket handle cap being achieved.

1 Claim, 5 Drawing Sheets

RACKET HANDLE CAP

BACKGROUND OF THE PRESENT INVENTION

The present invention relates to a racket handle; more particularly, it relates to an improved racket handle which can be easily put on the handle and makes the users grip comfortably.

Please refer to FIG. 1 and 2, accordingly, the racket frame 10 is made of single piece constructed carbon graphite. However, the conventional racket handle 20 is made by the steps as follows: put the handle part 101 in a structural form molding machine which is poured into liquid polyurethane foam (commonly called PU foam), then heat the handle part 101 with the polyurethane foam in 70° C. three minutes, take the racket frame 10 out of the structural form molding machine; the conventional racket handle 20 is formed. A single piece plastic injection molded end cap of the handle 21 is inserted over the conventional handle 20. A plurality of securing tacks 22 are provided for nailing the end cap 21 and the conventional handle 20 together. A strip of adhesive tape 40 is provided for wrapping up the conventional handle 20.

According to the above-mentioned process of manufacturing, it is not difficult to discover that this manner takes a lot of time and cost; moreover, the hardness of the polyurethane foam is about 90 degrees (in Shore Hardness A) when the polyurethane foam congeals, and this hardness makes the user feel uncomfortable when he grasps the conventional handle 20. Again the end cap 21 is made by single-piece plastic injection, and the hardness of the end cap 21 is even higher than that of the conventional handle 20. When the player wants to make his serve powerful, usually he will grasp the racket with the end cap 21 in his palm, in this way the effective swinging radius of his arm and the racket will be increased. However, the hardness of the end cap 21 not only causes pain to the player's palm but would also cause callus to form.

OBJECTS OF THE PRESENT INVENTION

The main object of the present invention is to provide an improved racket handle which makes the players have a firm yet comfortably pliant grip. Another object of the present invention is to provide an improved racket handle which is quickly and easily produced and assembled can drastically reduce the cost.

SUMMARY OF THE PRESENT INVENTION

The present invention provides a racket handle cap which is single-piece injection molded and made of pliant materials such as thermoplastic rubber. The racket handle comprises an opening at one end, an internal cavity, a grip portion having a plurality of oval air circulation vents and circular air circulation vents, a flaring section at the other end therewithin an octagon plastic end plate being engaged. The opening has an internal cavity elongately extending along the grip portion for permitting the handle part of the racket frame inserting thereinto. A plurality of counter-weights are optionally inserted within the oval circular air circulation vents to adjust the weight of the racket handle. An adhesive tape is provided for wrapping over the racket handle cap.

BRIEF DESCRIPTION OF THE PRESENT INVENTION

DETAILED DESCRIPTION OF THE PREFERRED EMBODIMENT

Figure 4:
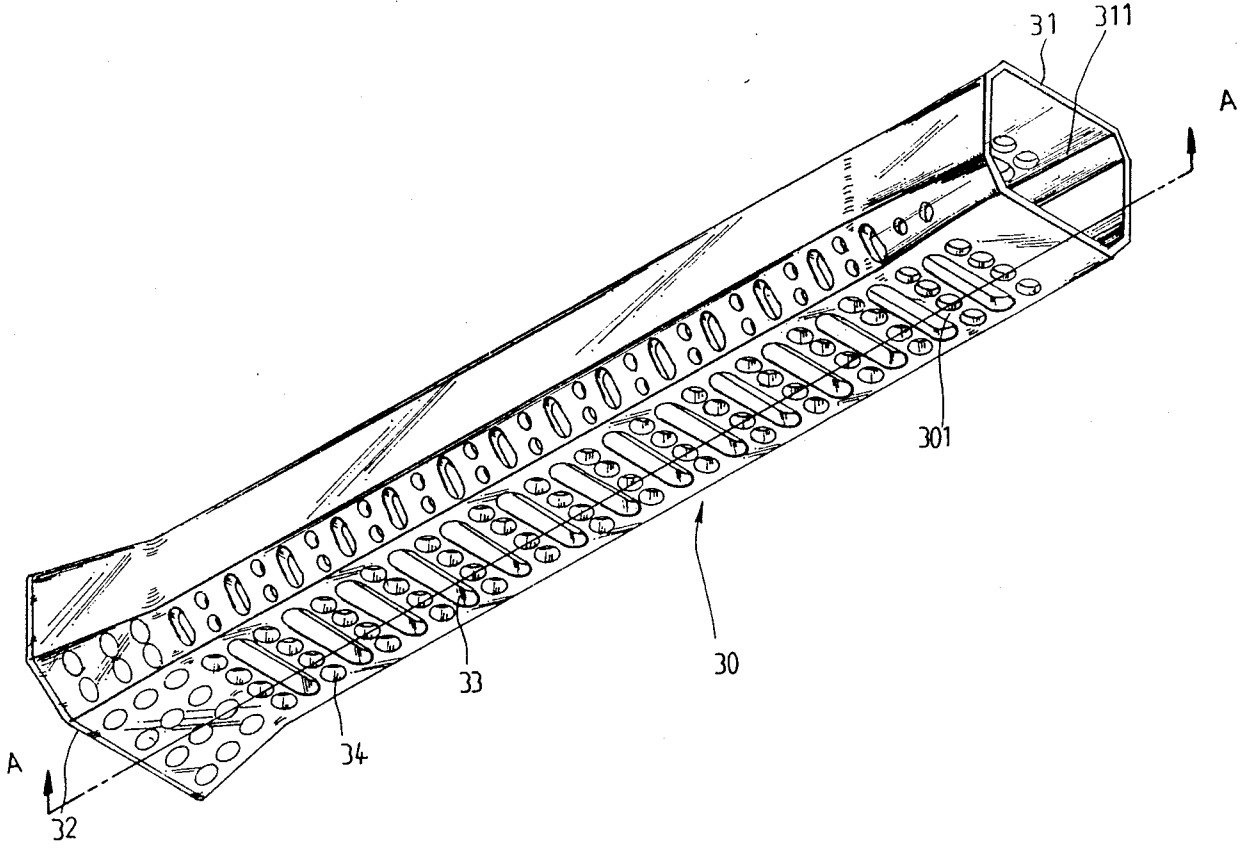
FIG. 4 is a perspective view of the preferred embodiment of the present invention.
Figure 5:
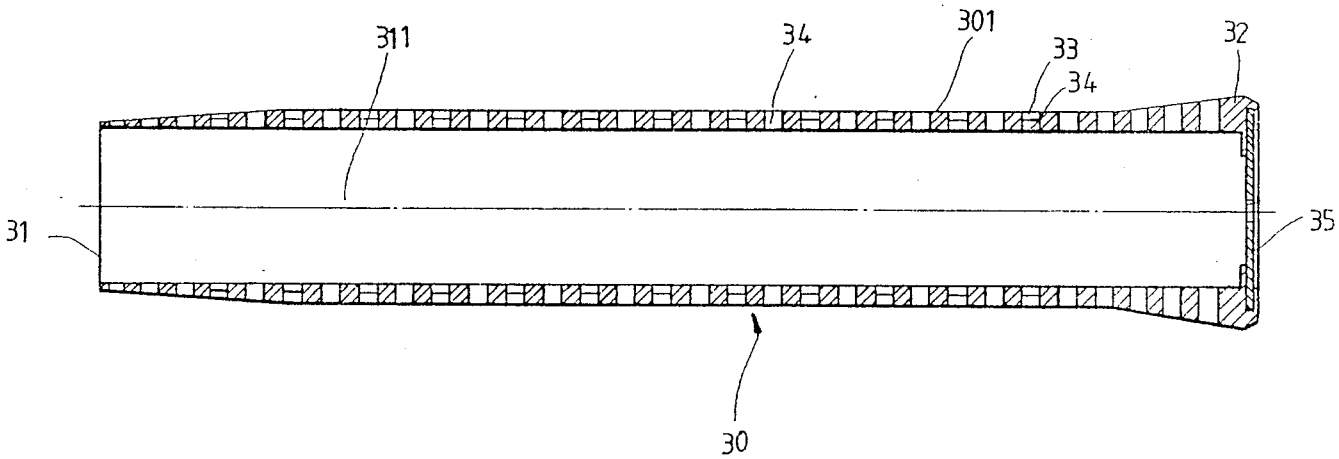
FIG. 5 is a cross-sectional view of the preferred embodiment of the present invention taken on the line A—A of FIG. 4.

Please refer to FIG. 4, the present invention provides an octahedral racket handle cap 30 which is single-piece injection molded and made of pliant materials such as thermoplastic rubber. The octahedral and improved racket handle cap 30 comprises an opening 31 at one end therefrom extending elongately to form a grip portion 301, a flaring section 32 and an octagon plastic end plate 35. An internal cavity 311 is defined by elongately extending from the opening 31 to the flaring section 32 along the grip portion 301. A plurality of oval air circulation vents 33 and circular circulation vents 34, respectively in rows, are formed on the grip portion 301 of the racket handle cap 30. The end plate 35 is attached to the rear portion of the flaring section 32, as shown in FIG. 5.

Figure 1:
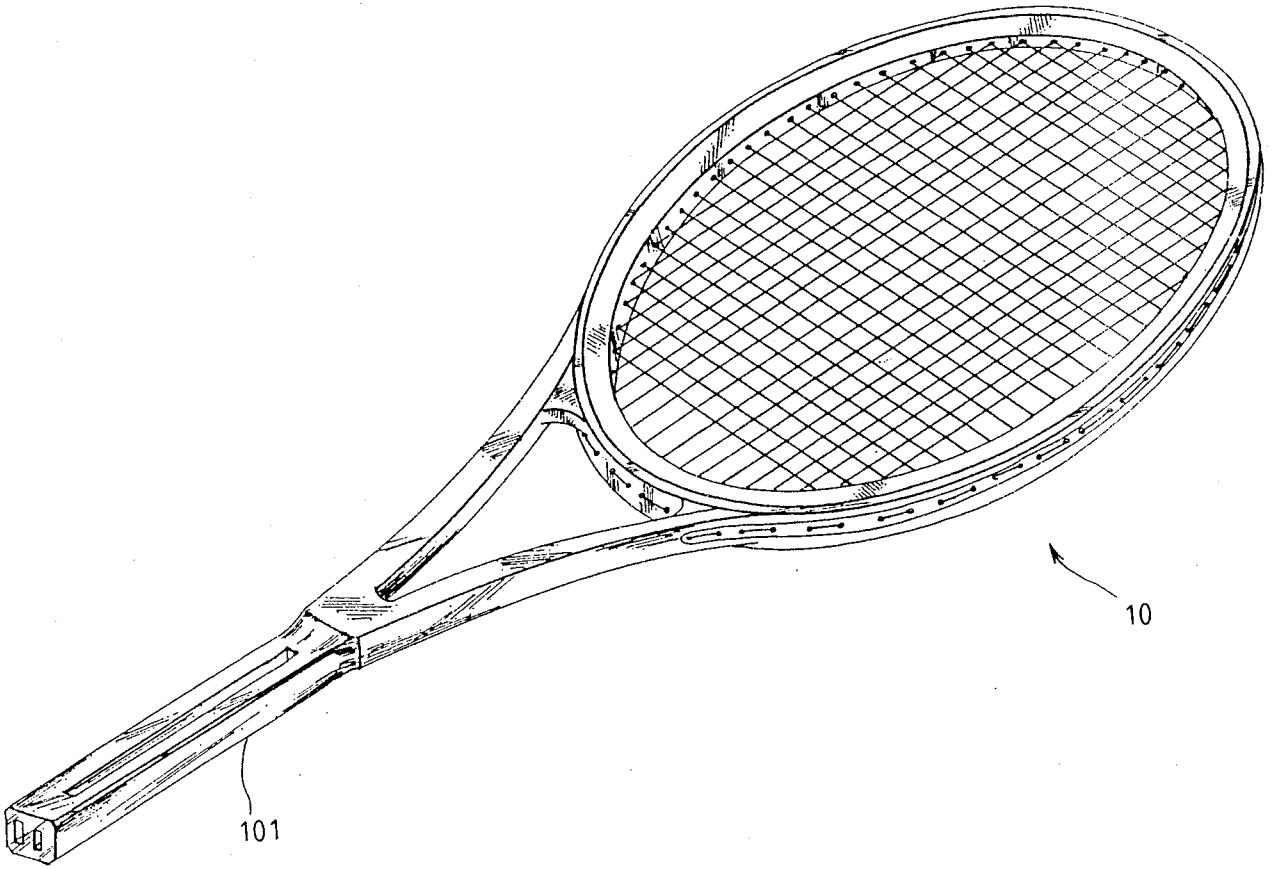
FIG. 1 is a perspective view of a single-piece constructed racket frame.
Figure 2:
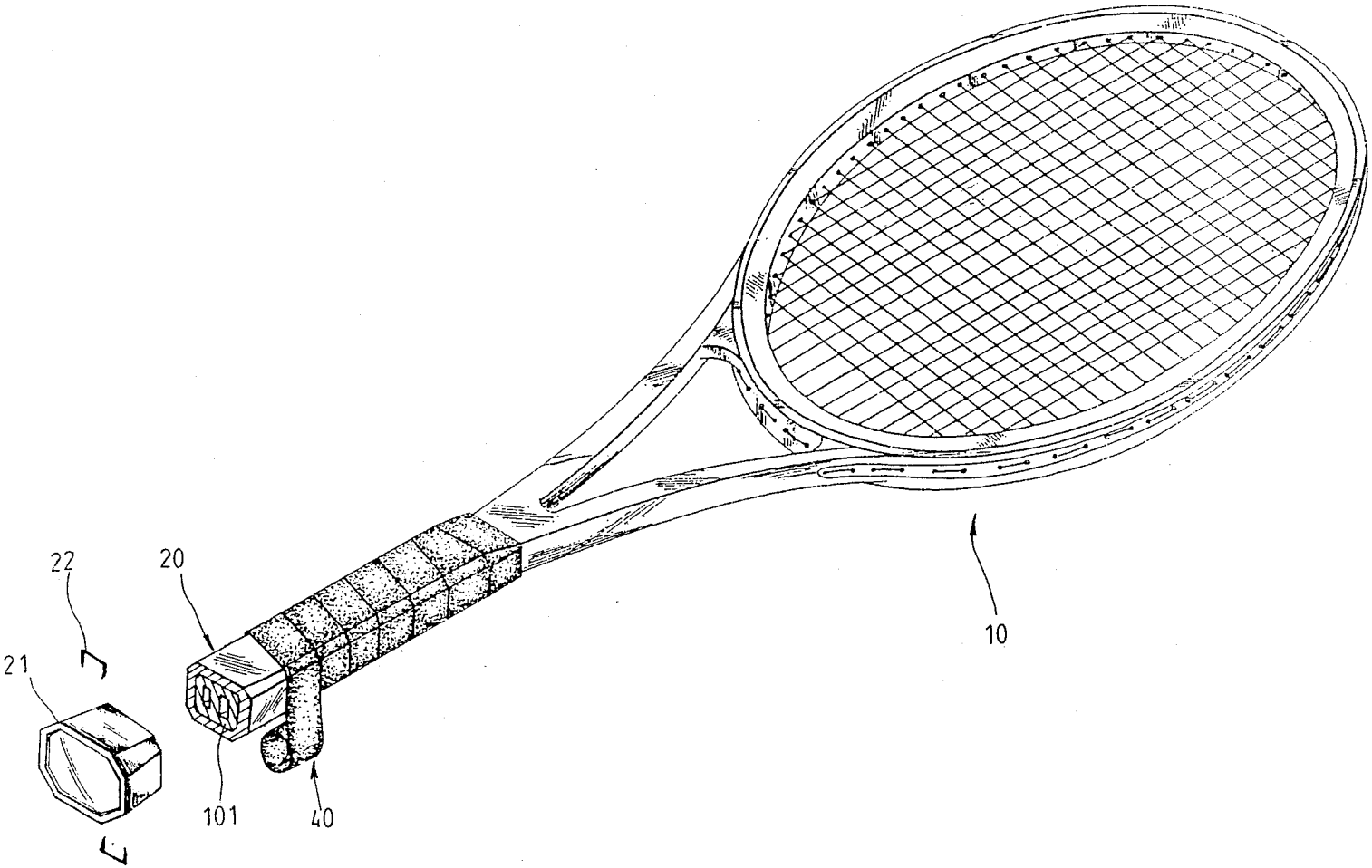
FIG. 2 is a perspective view of a conventional racket.
Figure 3:
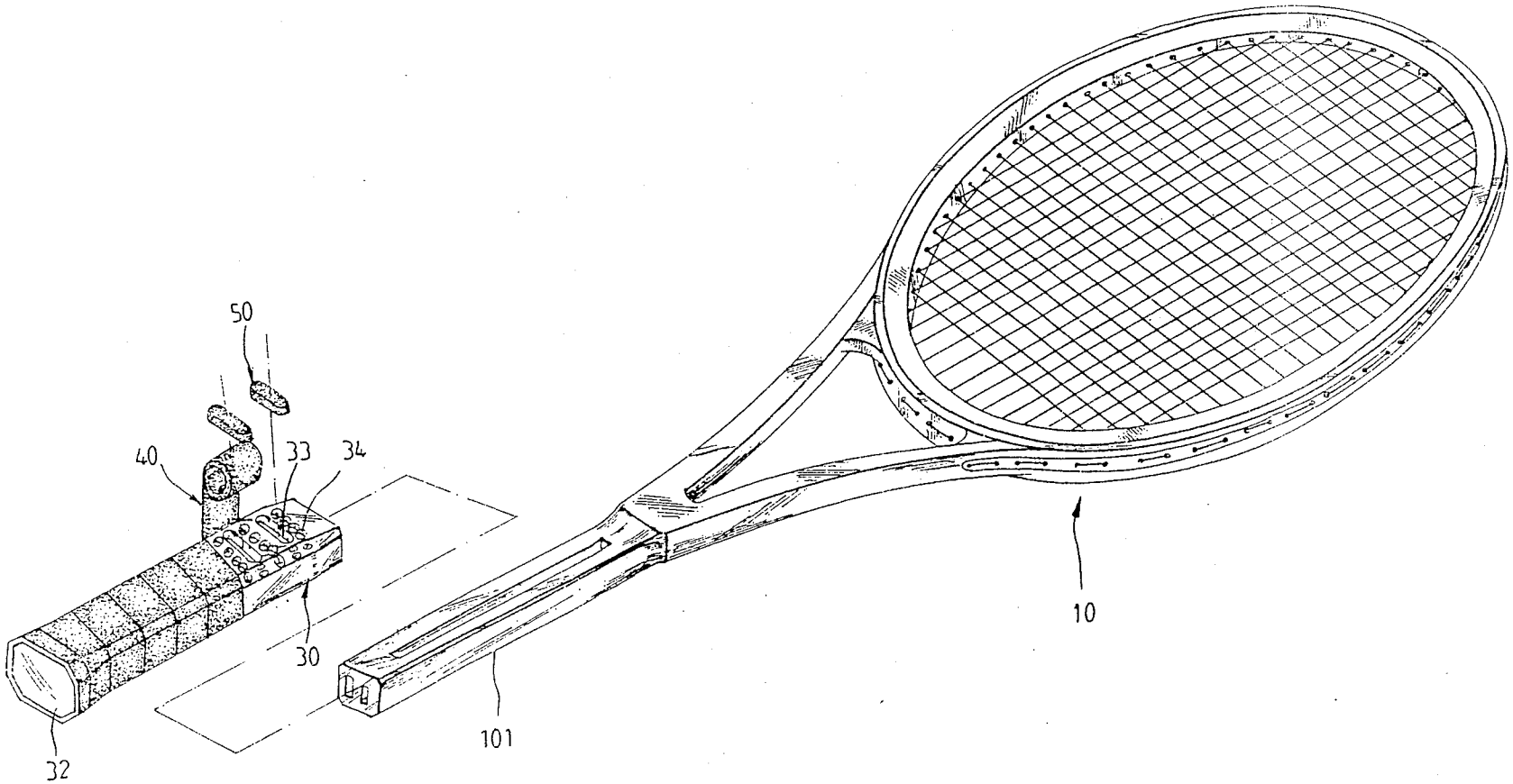
FIG. 3 is a perspective view of the preferred embodiment of the present invention (with the single-piece constructed racket frame).

The hardness of the improved handle 30 is approximately from 55 to 60 degrees in Shore Hardness A and this is much more pliant than the existing handle of the conventional racket. The internal cavity 311 of the opening 31, as shown in FIG. 3, is substantially equal to the size of the handle part 101 for the insertion of racket handle cap 30 over the racket frame 10. The handle cap 30 and the racket frame 10 are connected together by connecting means such as gluing. The main purpose of those oval and circular air circulation vents 33, 34 is to eliminate the air from the internal cavity 311 where the air originally exists. Moveover, a plurality of counter-weights 50, conforming in shape with the oval and circular air vents 33 and 34, are optionally and removably inserted therewithin to adjust the weight and weight distribution and adjustment of the racket. The octagon plastic end plate 35 is engaged within the flaring section 32, while the handle cap 30 is in its single piece injection molding, whereby the octagon plastic end plate 35 being encompassed therewithin. The purpose of the octagon plastic plate 35 is to be a stiffener for the rear portion of the racket handle cap 30 and ensuring a comfortable grip. An adhesive tape 40 is provided for wrapping over and attached to the racket handle cap 30, after the handle cap 30 and the handle part 101 of the racket frame 10 are connected firmly together by gluing.

Further modifications of the invention herein described will occur to persons skilled in the art and all such modifications are deemed to be within the scope of the invention as defined by the appended claims.

I claim:

1. A racket handle cap which is single piece injection molded and made of pliant materials such as thermoplastic rubber in the range of Shore A Hardness about 55 to 60, comprising: an opening at one end elongately extending along a grip portion to a flaring section to define an internal cavity, a plastic end plate, an adhesive tape and a plurality of counter weights;

said internal cavity of said opening being substantially equal to the size of the handle part of a racket frame for permitting said racket handle cap inserting thereover;

said grip portion having a plurality of oval air circulation vents and circular air circulation vents being respectively formed thereon in rows for eliminating the air therethrough by inserting the handle part of a racket frame within said internal cavity;

said counter weights respectively conforming in shape with said oval and circular air circulation vents for defining their optional and removal insertion into said oval and circular air circulation vents, the weight adjustment and distribution of said racket handle cap being achieved;

said plastic end plate having an elasticity greater than said racket handle cap in Shore Hardness A for being engaged within said flaring section, ensuring a comfortable grip;

said adhesive tape being provided for wrapping over and attaching to sasid racket handle cap and securing said counter weights to said oval and circular air circulation vents of said grip portion.

* * * * *